United States Patent [19]

Heidmann

[11] Patent Number: 4,913,493

[45] Date of Patent: Apr. 3, 1990

[54] FLEXIBLE STRUCTURE

[75] Inventor: Charles Heidmann, Strasbourg, France

[73] Assignee: Strafor S.A., Strasbourg, France

[21] Appl. No.: 243,903

[22] Filed: Sep. 13, 1988

[30] Foreign Application Priority Data

Sep. 22, 1987 [FR] France ..... 87 13247

[51] Int. Cl.[4] ..... A47C 7/44

[52] U.S. Cl. ..... 297/306; 297/300; 297/DIG. 2

[58] Field of Search ..... 297/285, 296, 297, 299, 297/300, 306, 454, 457, DIG. 2

[56] References Cited

U.S. PATENT DOCUMENTS 4,379,589 4/1983 Marino ..... 297/299
4,585,272 4/1986 Ballarini ..... 297/296 X
4,733,910 3/1983 Brennan ..... 297/285 X

FOREIGN PATENT DOCUMENTS 860938 1/1941 France ..... 297/306
4909 8/1987 World Int. Prop. O. ..... 297/306

*Primary Examiner*—Peter H. Brown
*Attorney, Agent, or Firm*—Morgan & Finnegan

[57] ABSTRACT

Semi-rigid structure which ability to the unidirectional deformation can be controlled, and particularly utilizable in the making of "ergonomic" seats, characterized in that it consists in a succession of parallel blocks 5 of rigid material joined together by narrow webs (7) of thinner and/or more flexible material, the deformation of the structure resulting from the pressing of all the webs, such a pressing being limited by ribs 8 placed inside the foresaid webs.

2 Claims, 5 Drawing Sheets

FLEXIBLE STRUCTURE

Figure 1B:
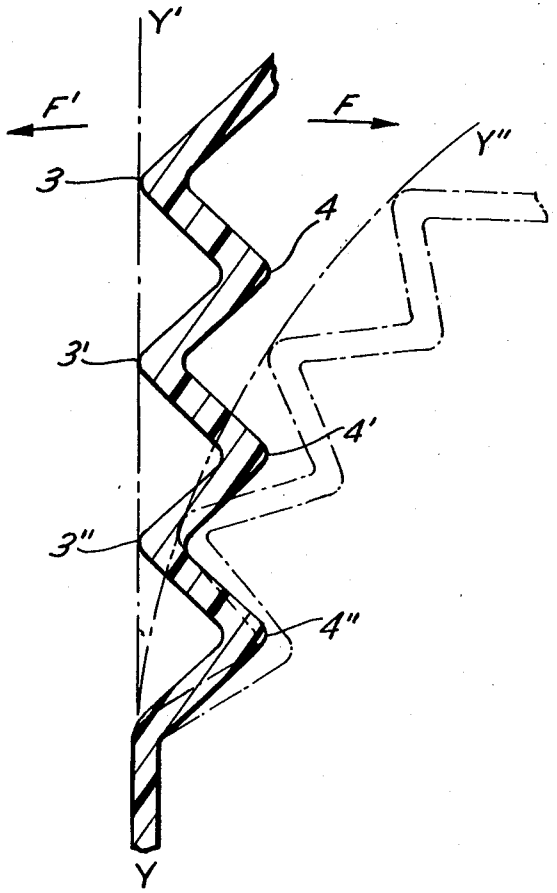
PRIOR ART FIG. 1b

The invention relates to a new semi-rigid structure having the controlled ability to be unidirectionally deformed, particularly used for the making of ergonomic seats.

Several studies of the last years about the importance of the "comfort" of seats, particularly concerning office seats, about the physical well-being, and consequently about the profitability of the sitting persons, resulted in the design of seats comprising means allowing the adaptation of such seats to the profile of each person and to the corresponding positions. Such seats are called "ergonomic" and the foresaid means concern the adjustment of the height of different elements of the seat and the capacity of these elements to be rocked and/or inclined in precise zones, particularly in the back, according to the position of the person.

For this purpose, different means were studied, including for example the deformation capacity of the upper seat-back in relation to the seating, or of the upper part of the seat-back in relation to the lower part. The common deficiency of all of the present systems is the control lack of the deformation amplitudes.

Thus, the U.S. Pat. No. 4,557,521 describes a seat, the back of which can be elastically inclined backwards, because of the thrust of the back of the person. owing to a flexible elastic zone, taking the shape of a cylindrical segment jointing the fixed seating to the back and made of a single rigid piece. In this case, if the sitting person feels like resting her head on the upper part of the back, the persons have to rock the whole back, but there is no security limits for this rocking backwards. Of course, instead of a single cylindrical segment, one proposed flexible zones constituted by parts of supple material, corrugated or bent in accordion, as described in the document ARGOFLEX 44 from the firm Albert Stoll Argoflex AG. The disadvantage of such corrugated parts is firstly to constitute a weaked zone of the structure; secondly, such a part can become deformed, without limits, in both ways.

The invention concerns a structure with a basic different design, which can be deformed in only one way, comprising means limiting this deformation at the maximal value allowing the comfort of a person.

For this purpose, the structure according to the invention consists in a succession of parallel blocks of rigid material joined together by narrow grooves in tighter and/or more flexible material, the deformation of the structure resulting from the pressing of all the grooves, such a pressing being limited by ribs placed inside the foresaid grooves.

In such a structure, the deformation of each groove is very small, forming an angle about 1°, and the amplitude of the complete deformation of the structure can consequently be controlled with good precision by the total number of the block-groove pairs constituting the structure. Thus, it is possible to adapt precisely a seat to the profile of the person. Such seat can be called "ergonomic" which was not the case with the previous seats.

The structure according to the invention is consequently particularly advantageous for the making of such seats, for example office seats, the back of which comprising an upper part lightly inclinable backwards to increase the comfort of the person, since this way he can relax when moving the shoulders backwards. Of course, such structures can be adapted to any other part of any kind of seats with the same advantages.

Thus, according to a preferred embodiment of the invention, the structure is especially designed for a seat, the back of which is curved to be adapted to the curve of the body. In this case the structure is placed in the central part of the back, because its elements are curved, since the lateral flat parts are fixed to the structure, playing the role of maintaining hinge of the central part.

Figure 1A:
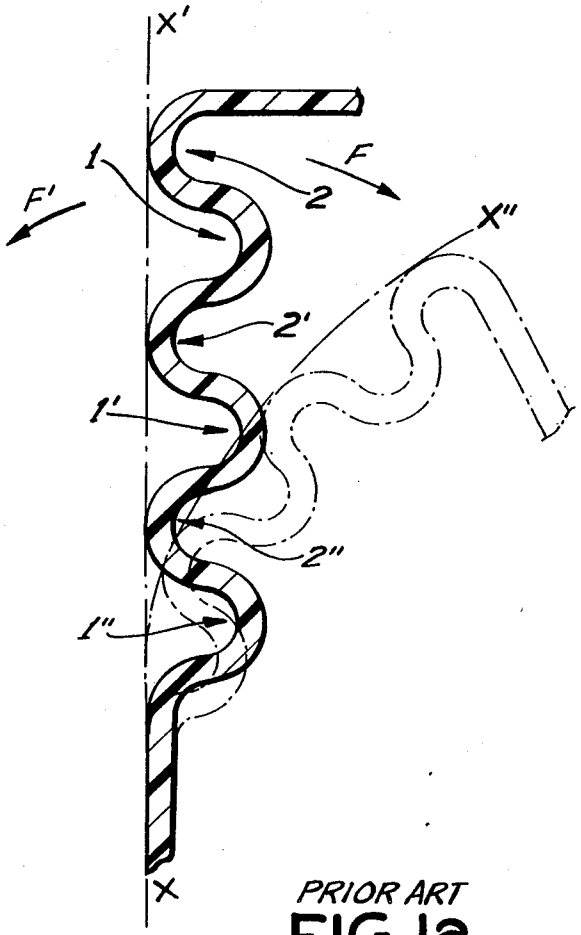
PRIOR ART FIG. 1a
Figure 2:
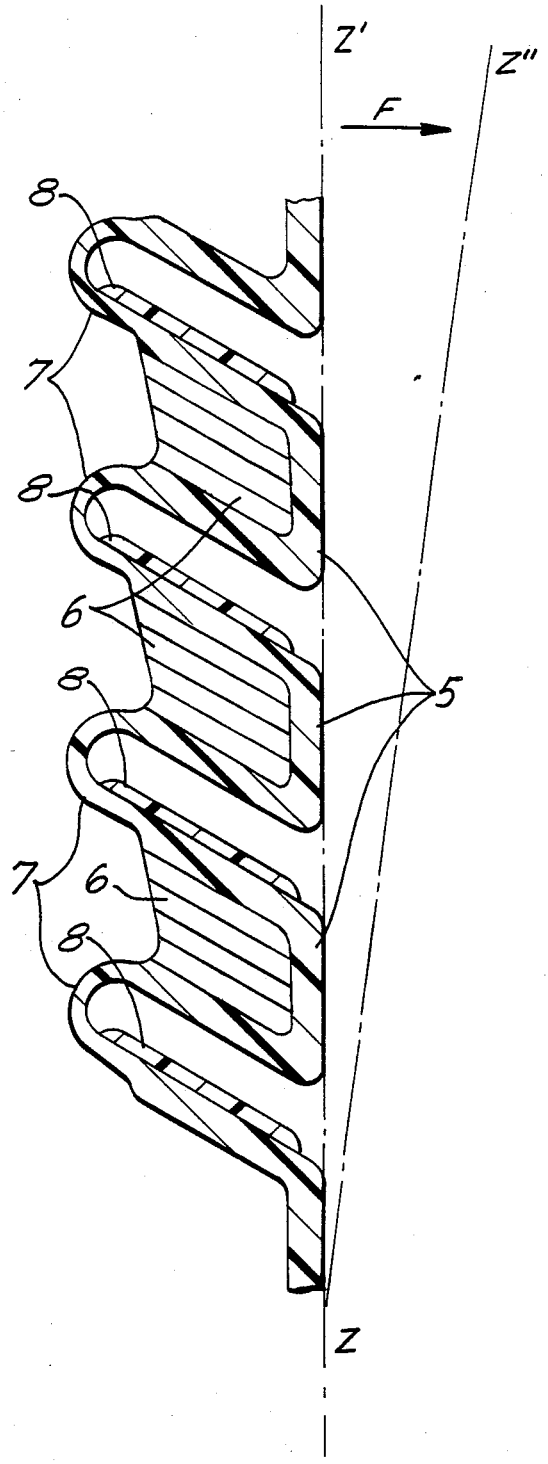
Figure 3:
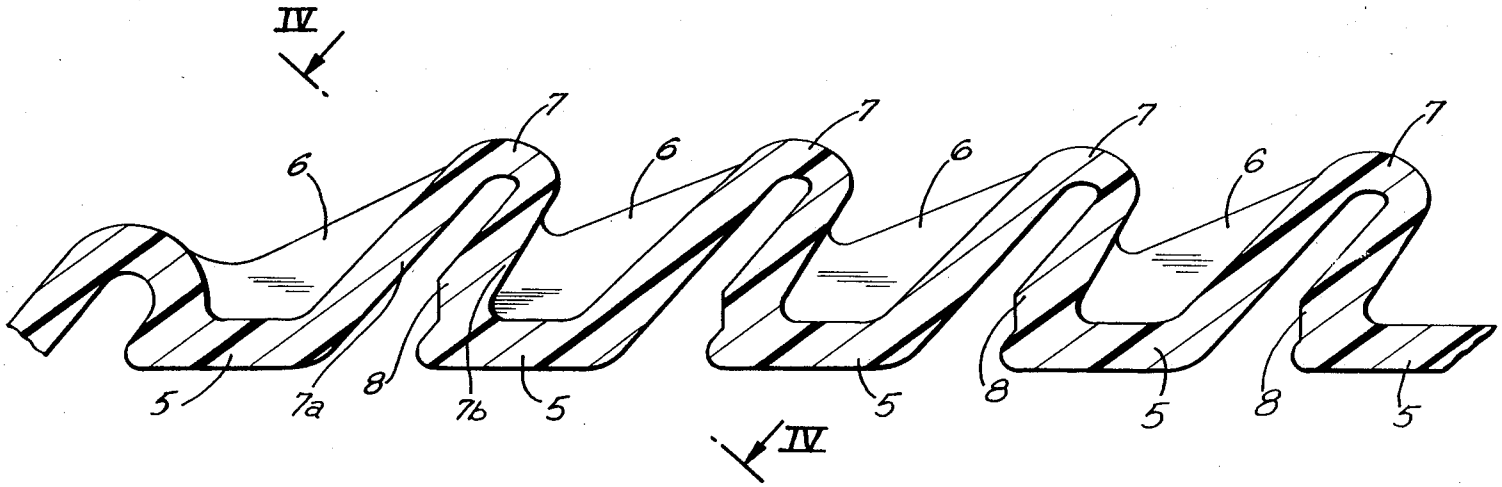
Figure 4:
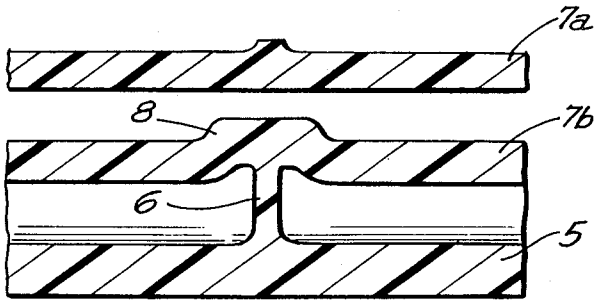

Now we will described the invention, referring to the drawings, in which:

FIGS. 1*a* and 1*b* illustrate schematically prior art flexible structures, FIG. 2 shows the principle of the structure according to the invention, FIG. 3 is a cross section of a detail of the structure according to the invention, and, FIG. 4 is a section IV—IV of FIG. 3

Figure 5:
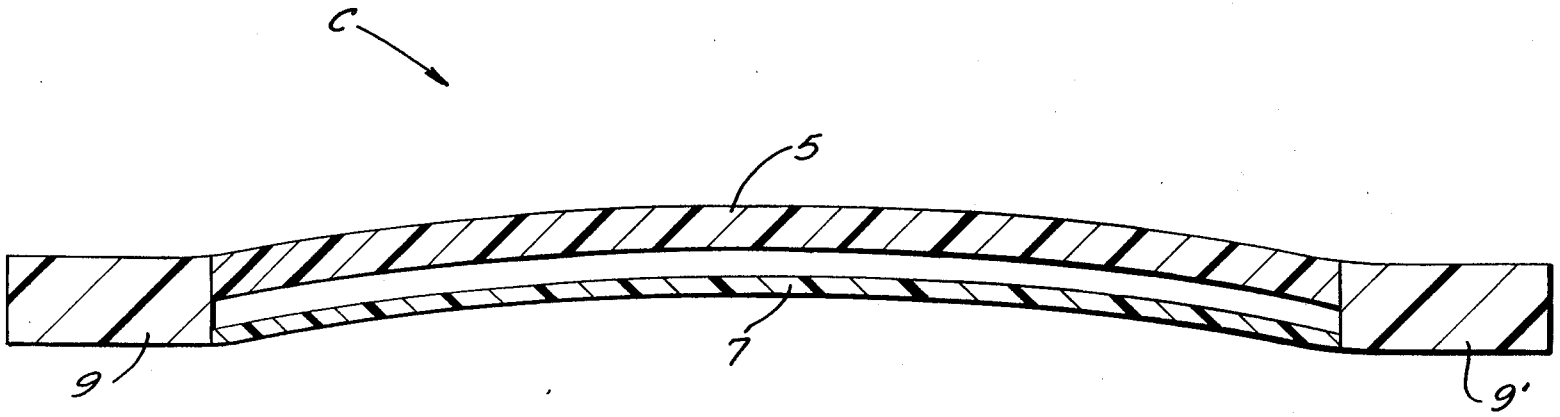
Figure 6:
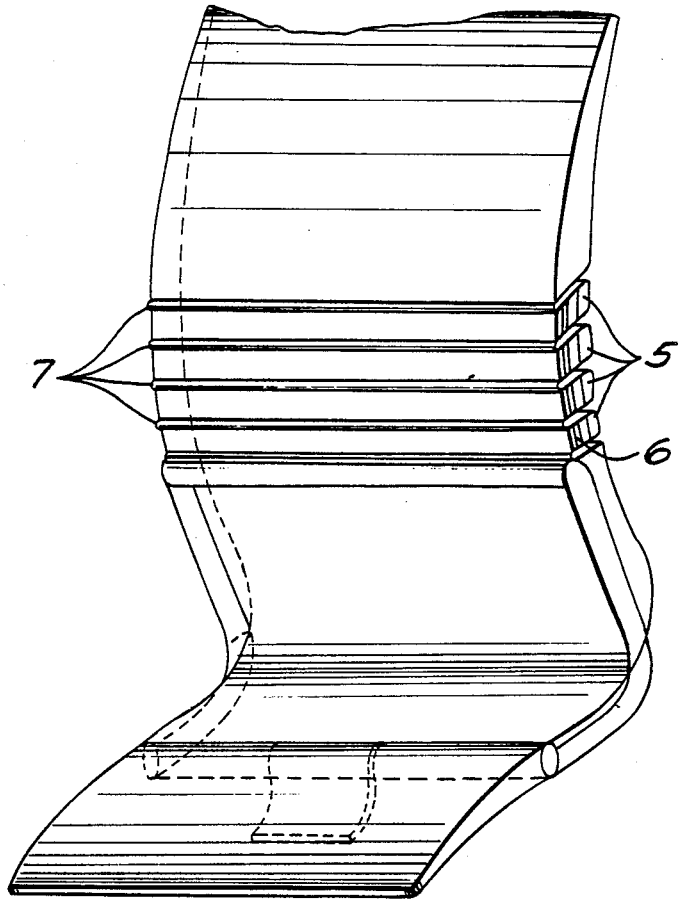

FIG. 5 is a horizontal section of a seat-back according to the invention, in a level including the structure.

Referring previously to the FIGS. 1*a* and 1*b*, both present structures are shown, firstly of corrugated material, including hollows 1,1′,1″ in a first side and hollows 2,2′,2″in the other side, and secondly in accordion, presenting pleats 3,3′,3″ in one side and 4,4′,4″ in the other side.

At rest, the figure shown in FIG. 1*a* is rectilinear, in the XX′ direction, the hollows 1 being equal to the hollows 3, and the structure of FIG. 1*b* is also rectilinear, in the YY′ direction, the angles of the pleats being equal to the angles of the pleats 4.

When deforming these structures in the direction of the arrow F, they become curved, as shown by XX′ on the FIG. 1*a* and yy′ on the FIG. 1b; the hollows 1 or the angle 3 diverging since the hollows 2 or the angle 4 become narrow. Such a deformation has both characters:

the amplitude is very difficult to verify it can be deformed in the sense of F or in the contrary sense of F′.

Consequently, it is not possible with such structure to foresee and adapt (accordingly to the person) the deformation of a zone of the seat where it is introduced. Furthermore, such seats are not really "ergonomic".

Referring now to the FIG. 2, the structure according to the invention includes rigid blocks 5, separated by ribs 6 and jointed by webs 7 of thinner and/or more flexible material, constituting the only parts of the structure which can be deformed.

The thickness of each web being small, when a thrust is applied on the structure in the direction F, the direction of the whole structure becomes ZZ″, which was ZZ′ at rest, the angle Z′ZZ″ being small, and depending on the number of webs. Moreover, to limit this angle, at least inside several webs. The control of the deformation of the structure depends consequently on two foreseable factors, the number of webs 7 and of ribs 8.

By another way, resulting from the very constitution of the structure, it can only be deformed in the direction F, and absolutely not in the contrary direction.

An embodiment of this structure is shown on FIG. 3 and FIG. 4, where the same elements have the same references, but where the dimensional factors which are the direct cause of the behaviour of the structure appear:

thus, in this example, each block 5 is 3 mm thick, since the curve of each web 7 is only 2.25 mm thick. Each web is 12 mm deep, and the opening equals 4 mm, since each rib 8 is 2 mm thick, allowing each web a deflection of 2 mm and an angular deformation of 1°. The reinforcing ribs 6 between each web are 1.5 mm thick. It results from those figures that the deformation ability of such a structure can be controlled with a great precision, about 1°, allowing consequently the adaptation of the structure to any conformation: that is the very definition of an "ergonomic" seat.

Lastly, referring to the FIG. 5, the horizontal section of a seat-back comprises a central part C curved in the vertical sense in order to be adapted to the conformation of the back of the person, and two flat lateral parts 9 and 9'. Of course, normally, a part curved in the vertical sense cannot be bent in the horizontal sense. On the contrary, the structure according to the invention allows such a bending, which presents a considerable improvement and is an important character of the invention. The two flat lateral parts 9 and 9' allow the control of the horizontal bending of the structure 4–5, when playing the role of the hinges.

The invention resolves consequently the problem of making of such seats with an absolutely new and original way. Moreover, the structure according to the invention can be adapted to any situation.

I claim:

1. Structure having a predetermined flexible ability in a single direction, said structure comprising a solid plate of semi-rigid plastic material in one face of which is provided a series of substantially parallel slits in a direction oblique to the other face of said plate, said slits defining in said plate a corresponding number of substantially parallel longitudinal blocks separated by a plurality of reinforcing ribs, said blocks being joined by webs of flexible material defining the bottom of said slits, said slits further comprising at least one rib formed on one wall of at least one of said slits, said rib being parallel to said wall of said slit such that a distorting force exerted on the uncut face of said plate causes a flexural effect upon the entire plate limited by the abutment of one side wall of said slit with said rib formed in the other side wall.

2. Structure as in claim 1 wherein the ratio of width to depth of each said slit limits the flexural angle of said slit to about 1°.

* * * * *